US008312582B2

(12) United States Patent
Oak et al.

(10) Patent No.: US 8,312,582 B2
(45) Date of Patent: Nov. 20, 2012

(54) WASHING MACHINE AND CONTROL METHOD THEREOF

(75) Inventors: Seong Min Oak, Masan-si (KR); Hyun Sook Kim, Suwon-si (KR); Sung Hoon Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 425 days.

(21) Appl. No.: 11/785,889

(22) Filed: Apr. 20, 2007

(65) Prior Publication Data

US 2008/0016626 A1 Jan. 24, 2008

(30) Foreign Application Priority Data

Jun. 19, 2006 (KR) ..... 10-2006-0054933
Sep. 1, 2006 (KR) ..... 10-2006-0084407

(51) Int. Cl.
*D06F 33/00* (2006.01)
*D06F 39/02* (2006.01)
*D06F 25/00* (2006.01)

(52) U.S. Cl. ..... 8/159

(58) Field of Classification Search ..... 8/158, 159; 68/12.05, 12.18, 12.19, 12.21, 17 R, 23 R, 68/24

See application file for complete search history.

(56) References Cited

U.S. PATENT DOCUMENTS

| | | | | |
|---|---|---|---|---|
| 1,948,568 | A | 4/1930 | Faber et al. | |
| 2,023,013 | A * | 12/1935 | Faber et al. | 8/159 |
| 4,118,189 | A * | 10/1978 | Reinwald et al. | 8/137 |
| 5,253,380 | A | 10/1993 | Lim et al. | |
| 5,307,649 | A * | 5/1994 | Lim et al. | 68/12.05 |
| 5,653,129 | A | 8/1997 | Jang | |
| 2003/0208852 | A1 * | 11/2003 | Hardaway et al. | 8/158 |
| 2004/0040344 | A1 * | 3/2004 | Minayoshi et al. | 68/12.16 |
| 2004/0154645 | A1 * | 8/2004 | Kim | 134/18 |
| 2005/0081308 | A1 | 4/2005 | Kim et al. | |
| 2006/0000242 | A1 | 1/2006 | Yang et al. | |
| 2006/0101587 | A1 * | 5/2006 | Hong | 8/149.1 |
| 2009/0272155 | A1 | 11/2009 | Jeong et al. | |

FOREIGN PATENT DOCUMENTS

| | | |
|---|---|---|
| CN | 1389620 A | 1/2003 |
| CN | 1478943 A | 3/2004 |
| JP | 2002-306886 | 10/2002 |
| JP | 2005-7224 | 1/2005 |
| KR | 2005-39590 | 4/2005 |

(Continued)

OTHER PUBLICATIONS

Chinese Office Action issued Aug. 7, 2009 in corresponding Chinese Patent Application 200710102360.2.

(Continued)

*Primary Examiner* — Joseph L Perrin
(74) *Attorney, Agent, or Firm* — Staas & Halsey LLP

(57) ABSTRACT

The washing machine can wash laundry using bubbles. The control method includes generating detergent concentrate liquid required for generation of the bubbles, supplying the detergent concentrate liquid and water into a water tub, generating the bubbles from detergent water as a mixture of the detergent concentrate liquid and the water, followed by supplying the bubbles to laundry, and washing the laundry using the bubbles. The bubbles act as a cushion to reduce friction between the laundry, thereby preventing texture of the laundry from being damaged due to the friction between the laundry and strong water stream while allowing dirt on the laundry to be effectively removed due to a high concentration of detergent in the bubbles.

9 Claims, 9 Drawing Sheets

FOREIGN PATENT DOCUMENTS

WO 2006/129912 12/2006

OTHER PUBLICATIONS

European Search Report mailed Jan. 12, 2010 in corresponding European Patent Application 0710708.9.

U.S. Appl. No. 12/588,548, filed Oct. 19, 2009, Seong Min Oak et al., Samsung Electronics Co., Ltd.

U.S. Appl. No. 12/385,671, filed Apr. 15, 2009, Seong Min Oak et al., Samsung Electronics Co., Ltd.

Chinese Office Action dated Jun. 17, 2010 issued in corresponding Chinese Patent Application No. 200710102360.2.

U.S. Office Action dated Nov. 18, 2010 issued in the file history of U.S. Appl. No. 12/588,548.

U.S. Office Action dated Apr. 29, 2011, issued in the file history of U.S. Appl. No. 12/588,548.

U.S. Office Action dated Jul. 27, 2012, issued in the file history of U.S. Appl. No. 12/385,675.

* cited by examiner

WASHING MACHINE AND CONTROL METHOD THEREOF

CROSS-REFERENCE TO RELATED APPLICATIONS

This application claims the benefit of Korean Patent Application No. 2006-0054933, filed on Jun. 19, 2006, and Korean Patent Application No. 2006-0084407, filed on Sep. 1, 2006, in the Korean Intellectual Property Office, the disclosure of which is incorporated herein by reference.

BACKGROUND OF THE INVENTION

1. Field of the Invention

The present invention relates to a washing machine, and, more particularly, to a washing machine which can wash laundry only with bubbles, and a control method thereof.

2. Description of the Related Art

Generally, a washing machine (typically, drum washing machine) includes a drum-shaped water tub to contain water, and a rotational drum having a cylindrical shape and being rotatably installed in the tub, and is operated to wash laundry using a falling force of the laundry, which is raised and dropped within the rotational drum while the rotational drum is rotated.

With such a washing machine, when a washing course is selected by a user, an amount of water is determined depending on a weight (load) of the laundry, and water and detergent are supplied into the tub corresponding to the determined amount of water, followed by a washing operation using fall of the laundry caused by rotation of the rotational drum.

For this type of washing machine, however, since it is necessary to fill water in a space between the tub and the rotational drum for the washing operation, a great amount of water is generally consumed. The conventional washing machine has problems of large consumption of energy to heat the water, and a great amount of detergent to perform the washing operation corresponding to such a large consumption of water.

In addition, the conventional washing machine has a problem in that, for laundry such as wool, silk, etc. requiring a delicate washing operation, texture of the laundry is likely to be damaged due to the fall of the laundry by the rotation of the rotational drum, and friction of the laundry with water and other laundry.

SUMMARY OF THE INVENTION

Therefore, an aspect of the invention is to provide a washing machine, which enables an effective washing operation only with bubbles while preventing laundry from contacting water, and a control method thereof.

It is another aspect of the invention to provide the washing machine, which allows the bubbles to act as a cushion capable of reducing friction between the laundry, reducing damage of texture of laundry requiring a delicate washing operation, and enables an increase in cleaning degree by use of a high detergent concentration on the surface of the bubbles, and the control method thereof.

It is yet another aspect of the invention to provide the washing machine which permits control of a supply amount of water and an input amount of detergent to ensure generation of bubbles having a predetermined concentration, and the control method thereof.

It is yet another aspect of the invention to provide the washing machine which can generate the bubbles having a suitable detergent concentration according to a contaminated degree of the laundry, and the control method thereof.

Additional aspects and/or advantages of the invention will be set forth in part in the description which follows and, in part, will be apparent from the description, or may be learned by practice of the invention.

According to one aspect of the present invention, a control method of a washing machine performing a washing operation using bubbles is provided, including: generating detergent concentrate liquid required for generation of the bubbles; supplying the detergent concentrate liquid and water into a water tub; generating the bubbles from detergent water as a mixture of the detergent concentrate liquid and the water, followed by supplying the bubbles to laundry; and washing the laundry using the bubbles.

When generating the detergent concentrate liquid, a small amount of water may be supplied to the detergent in a detergent supply device, and dissolve the detergent therein to generate detergent liquid of a high concentration.

When supplying the detergent concentrate liquid along with the water into the tub, the detergent concentrate liquid and the water may be supplied into a space between the tub and a rotational drum so as not to contact the laundry input into the rotational drum.

The method may further include detecting a level of the detergent water as the mixture of the detergent concentrate liquid and the water.

The level of the detergent water may be controlled to allow the detergent water to be maintained at a bubble generating level to permit generation of the bubbles while preventing the detergent water from contacting the laundry.

When the level of the detergent water reaches a first level of preventing the detergent water from contacting the laundry, supplying of the detergent concentrate liquid and the water may be stopped, and when the level of the detergent water reaches a second level as the minimum level of detergent water required for generation of the bubbles, the supplying of the detergent concentrate liquid and the water may be started.

The detergent concentrate liquid may be supplied at a constant amount into the space between the rotational drum and the tub so as to maintain concentration of the detergent water.

A supply amount of the water may be controlled at a predetermined ratio to an input amount of the detergent concentrate liquid in the space between the rotational drum and the tub so as to maintain a concentration of the detergent water.

When the level of the detergent water reaches the first level of preventing the detergent water from contacting the laundry, the amount of water may be controlled by stopping the supply of the water.

When the level of the detergent water is at a bubble generating level, the bubbles may be generated by injecting air to the detergent water.

When generating the bubbles, the rotational drum may be driven with the laundry input into the rotational drum.

The method may further include removing the bubbles remaining on the laundry after performing the washing operation using the bubbles.

The removing of the bubbles may be at least one of removing the bubbles through intermittent spin-drying after water discharge, removing the bubbles through air-blowing with a drying fan after the water discharge or simultaneously with the water discharge, and removing the bubbles through supply of a small amount of water after the water discharge.

When blowing air with the drying fan, a drying heater may be operated to supply hot air.

According to another aspect of the present invention, a washing machine including a rotational drum into which laundry is input, and a water tub to perform a washing operation using bubbles, further including: a water supply device to control supply of water; a detergent dissolving device to generate detergent concentrate liquid required for generation of the bubbles; an air supply device to supply air required for the generation of the bubbles; and a controller to control the water supply device and the detergent dissolving device to supply the water and the detergent concentrate liquid into a space between the rotational drum and the tub, to control the air supply device to generate the bubbles by supplying detergent water as a mixture of the water and the detergent concentrate liquid, and to perform the washing operation using the bubbles.

The washing machine may further include a detergent supply device to contain the detergent input thereto and a water supply line to supply the water into the detergent supply device, wherein some of the water supplied through the water supply line is supplied into the detergent dissolving device, and generates the detergent concentrate liquid in the detergent dissolving device by dissolving the detergent input to the detergent supply device.

The washing machine may further include a level detection unit to detect a level of the detergent water supplied to the space between the rotational drum and the tub, and the controller controls the level of the detergent water supplied into the space between the rotational drum and the tub.

The level detection unit may be constituted by a level sensor to detect the level of the detergent water between the rotational drum and the tub.

The level detection unit may be constituted by a first level sensor to detect a first level of preventing the detergent water from contacting the laundry, and a second level sensor to detect a second level as the minimum level of detergent water required for the generation of the bubbles.

The water supply device and the detergent dissolving device may include valves, respectively, and the controller may block the respective valves of the water supply device and the detergent dissolving device to stop supply of the water and the detergent concentrate liquid from the water supply device and the detergent dissolving device, respectively, when detecting the level of the first level sensor.

The water supply device and the detergent dissolving device may include valves, respectively, and the controller may open the respective valves of the water supply device and the detergent dissolving device to start supply of the water and the detergent concentrate liquid from the water supply device and the detergent dissolving device, respectively, when detecting the level of the second level sensor.

The detergent dissolving device may further include a first flow control valve to control a flux of detergent concentrate liquid to supply a predetermined amount of detergent concentrate liquid.

The water supply device may further include a second flow control valve to control a flux of water, and the controller may control the first and second flow control valves to supply the water at a predetermined ratio to the flux of detergent concentrate liquid.

The air supply device may include an air motor positioned under the tub to supply air; an air supply line to transfer the air supplied from the air motor; and a porous member positioned at an end of the air supply pipe to inject the transferred air.

The tub may be formed with an air hole through which to air flows from the air supply device into the tub.

The controller may remove the bubbles by driving the rotational drum in an intermittent spin-drying manner after completing the washing operation using the bubbles.

The washing machine may further include a drying fan, wherein the controller removes the bubbles by operating the drying fan to blow air into the rotational drum after completing the washing operation using the bubbles.

The washing machine may further include drying heaters, wherein the controller removes the bubbles by simultaneously operating the drying heater and the drying fan to blow hot air into the rotational drum after completing the washing operation using the bubbles.

The washing machine may further include a water supply nozzle to inject the water in the form of spray, wherein the controller may remove the bubbles by driving the rotational drum for spin-drying while injecting the water in the form of spray after completing the washing operation using the bubbles.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
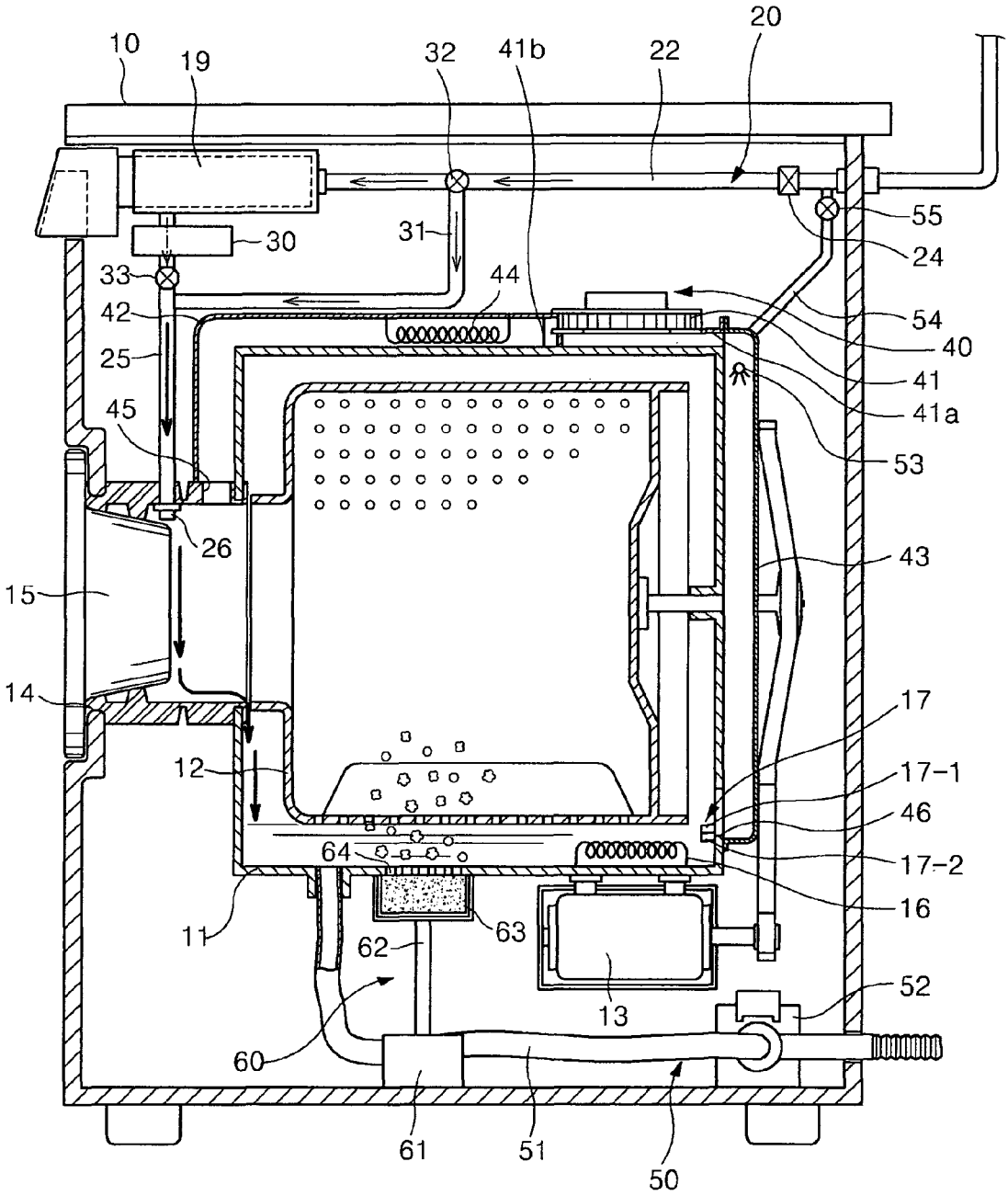
FIG. 1 is a cross-sectional view showing the construction of a washing machine according to the present invention.

Reference will now be made in detail to the embodiments of the present invention, examples of which are illustrated in the accompanying drawings, wherein like reference numerals refer to the like elements throughout the drawings. The embodiments are described below to explain the present invention by referring to the figures.

FIG. 1 is a cross-sectional view showing the construction of a washing machine according to the present invention.

Figure 2:
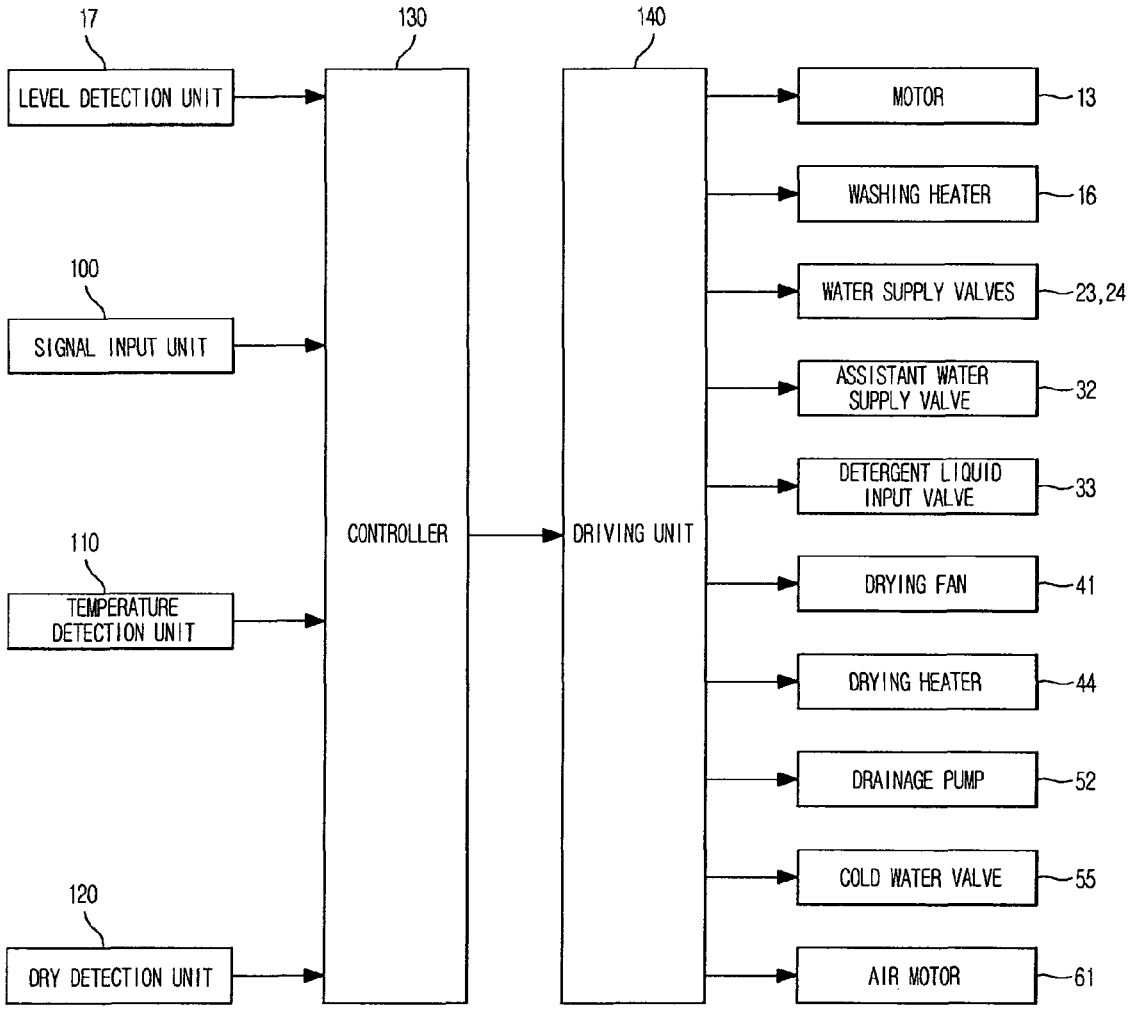
FIG. 2 is a block diagram showing the construction of a controller for the washing machine.

As shown in FIGS. 1 and 2, the washing machine according to the present invention performs a washing operation using bubbles, and includes a drum-shaped water tub 11 positioned in a main body 10 to contain water, and a rotational drum 12 rotatably installed within the tub 11 and having a plurality of spin-drying holes.

The tub 11 is provided with a motor 13 positioned therebelow to rotate the rotational drum 12 in the clockwise or counterclockwise direction to perform washing, rinsing and spin-drying operations, a washing heater 16 positioned at a lower portion of the tub 11 to heat water supplied into the tub 11 in response to selection of a water temperature by a user, and a level detection unit 17 to detect an amount (level) of the water (specifically, detergent water) supplied into the tub 11.

The level detection unit 17 includes a first level sensor 17-1 which detects the maximum level (hereinafter, a first level) capable of preventing the detergent water from flowing into the rotational drum 12, into which the laundry is input, to perform the washing operation only with the bubbles, and a second level sensor 17-2 which detects the minimum level (hereinafter, a second level) required for generation of the bubbles. Through detection of the level detection unit 17, supply of detergent concentrate liquid and the water into the tub 11 is controlled to be stopped in order to prevent the detergent water from flowing into the rotational drum 12 when the detergent water reaches the first level upon the washing operation, or to be performed in order to supply the detergent water again for generation of the bubbles when the detergent water is gradually lowered to the second level due to the generation of the bubbles.

By means of the level detection unit 17, the detergent water is allowed to be maintained at a bubble generating level which permits generation of the bubbles while preventing the detergent water from contacting the laundry through continuous detection of the level in addition to the detection of the first and second levels. In addition, with help of the level detection unit 17, the detergent concentrate liquid and the water are supplied at amounts required for generation of the bubbles having a predetermined detergent concentration by measuring a reduced level through flow and time control during the bubble washing operation.

The body 10 has an opening 14 in front of the tub 11 and the rotational drum 12 such that the laundry can be removed from the front of the body 10, and a door 15 to open or close the opening 14.

The washing machine further includes a detergent supply device 19 positioned above the tub 11 to supply the detergent, a detergent dissolving device 30 to generate and store a predetermined amount of detergent concentrate liquid used for generation of the bubbles having the predetermined detergent concentration, and a water supply device 20 to supply water into the detergent supply device 19 and the detergent dissolving device 30.

The detergent supply device 19 is partitioned into a plurality of spaces, and is positioned near the front side of the body 10 to allow easy input of the detergent and a rinsing agent into the respective spaces.

The water supply device 20 includes a water supply line 22 to supply water, and a water supply valve 24 positioned on the water supply line 22 to control supply of water through the water supply line 22, which is connected to the detergent supply device 19 such that the water can be supplied from an outside to the detergent supply device 19. The detergent dissolving device 30 is connected between the detergent supply device 19 and the tub 11 such that the water passes through the detergent supply device 19 and is then supplied along with the detergent into the detergent dissolving device 30 to generate detergent concentrate liquid (in a state wherein the detergent is concentrated in the water) for generation of the bubbles having the predetermined detergent concentration. A separate connection line 25 is connected between the detergent dissolving device 30 and the tub 11, and has a water supply nozzle 26 positioned at an exit of the separate connection line 25 to allow the detergent concentrate liquid to be supplied from the detergent dissolving device 30 to the tub 11. This is for the purpose of allowing the detergent concentrate liquid in the detergent dissolving device 30 to be supplied together with the water into the tub 11 and form detergent water used for generation of the bubbles having the predetermined concentration between the tub 11 and the rotational drum 12.

The detergent dissolving device 30 is connected to the detergent supply device 19 to form a predetermined amount of detergent concentrate liquid required for generation of the bubbles and to supply the predetermined amount of detergent concentrate liquid between the tub 11 and the rotational drum 12, such that the detergent concentrate liquid (water with the detergent concentrate liquid dissolved at a high concentration therein) can also be supplied together with the water in order to prevent the concentration of the bubbles from varying from an initial concentration of the bubbles when the detergent water is additionally supplied through the water supply device 20 due to lack of the detergent water (water with the detergent concentrate liquid dissolved therein) resulting from generation of the bubbles. To this end, the detergent dissolving device 30 includes an assistant water supply line 31 connected to one side of the water supply line 22 connected to the detergent dissolving device 30 to allow water to be additionally supplied to the tub 11 without passing through the detergent supply device 19, an assistant water supply valve 32 provided to the assistant water supply line 31 to control additional supply of water to the tub 11, and a detergent liquid input valve 33 to control the detergent concentrate liquid of a high concentration in the detergent dissolving device 30 to be supplied by an amount required for generation of the bubbles having the predetermined concentration.

The assistant water supply valve 32 is a three-way valve that can control a direction of the water such that the water is supplied to the detergent supply device 19 or the assistant water supply line 31 through the water supply line 22. The assistant water supply valve 32 adjusts a supplying direction of water in such a way that, after a small amount of water (that is, an amount of water capable of forming the detergent concentrate liquid of the high concentration by dissolving the detergent of the detergent supply device 19) is supplied once into the detergent supply device 19 at an initial water supplying stage, the water is directly supplied into the tub 11 through the assistant water supply 31 along with the detergent concentrate liquid formed in the detergent dissolving device 30, in order to form the detergent concentrate liquid in the detergent dissolving device 30 by dissolving the detergent of the detergent supply device 19.

The washing machine of the invention further includes a drying device 40 to dry the laundry (clothes). The drying device 40 includes a drying fan 41 on the tub 11, a drying duct 42 connected between an outlet 41*b* of the drying fan 41 and an air induction port 45 formed on the opening 14 of the tub 11, and a condensing duct 43 mounted on the rear side of the tub 11 and connected between an air discharge port 46 formed at a lower portion of the rear side of the tub 11 and an inlet 41*a* of the drying fan 41.

The drying device 40 includes a drying heater 44 positioned inside the drying duct 42 to supply hot air into the tub 11, and a condensing device positioned on the condensing duct 43 to allow vapor generated when drying the clothes to be condensed and removed while the vapor passes through the condensing duct 43.

The condensing device includes a cold water injection nozzle 53 positioned at an upper portion inside the condensing duct 43 to inject cold water into the condensing duct 43, and a cold water supply line 54 connected to the water supply device 20 to supply the cold water to the cold water injection nozzle 53, and a cold water valve 55. With this structure, the condensing device enables an improvement in dehumidification effect to increase a contact area between humid air rising from a lower portion of the condensing duct 43 and the cold water by allowing the cold water from the cold water injection nozzle 53 positioned at the upper portion to flow to the lower portion of the condensing duct 43 along an inner surface of the condensing duct 43.

The washing machine of the invention further includes a water draining device 50 to drain water inside the tub to the outside. The water draining device 50 includes a drainage line 51 connected to a lower surface of the tub 11 to guide the water from the tub 11 to the outside, and a drainage pump 52 provided to the drainage line 51.

The washing machine of the invention further includes an air supply device 60 to wash the laundry in the rotational drum 12 by use of the bubbles. The air supply device 60 includes an air motor 61 positioned below the tub 11 to supply air, an air supply line 62 to transfer the air supplied from the air motor 61, and a porous member 63 positioned at an end of the air supply line 62 to disperse the air. After being generated by the air motor 61, air is dispersed through the porous member 63 via the air supply line 62, and generates air bubbles in the detergent water as a mixture of detergent concentrate liquid and water, generating bubbles, so that the laundry can be washed only with the bubbles within the rotational drum 12.

In addition, air holes 64 are formed through the tub 11 in which the air supply device 60 is positioned, and allows air to flow from the air supply device 60 into the tub 11 therethrough so that the air is induced into a space between the tub 11 and the rotational drum 12 after being dispersed through the porous member 63.

FIG. 2 is a block diagram showing the construction of a controller for the washing machine according to the present invention. In FIG. 2, the washing machine further includes a signal input unit 100, a temperature detection unit 110, a dry detection unit 120, the controller 130, and a driving unit 140 in addition to the devices shown in FIG. 1.

With the signal input unit 100, it is possible to input operation information, such as washing courses (for example, bubble washing course or general washing course), washing temperatures, spin-drying RPM, additional rinsing, etc., which can be selected by a user according to kinds of laundry, to the controller 130. In a bubble washing course, selected information such as bubble concentration is input to the controller 130.

The temperature detection unit 110 serves to detect the temperature of water supplied into the tub 11, and the dry detection unit 120 serves to detect a dried state of laundry through detection of the temperature and humidity of the laundry.

The controller 130 is a microcomputer which can control the washing machine according to operation information inputted from the signal input unit 100, and stores an RPM and operation rate of a motor and a washing period, which are set depending on a washing load (weight of laundry) in a selected washing course.

The controller 130 controls a motor 13, the water supply device 20, and the detergent dissolving device 30 to achieve an optimum washing effect while reducing damage of texture of the laundry by controlling supply amounts of water and detergent concentrate liquid together with generation of the bubbles upon the bubble washing operation, controlling the RPM and operation rate of the motor according to the washing load, and by controlling the bubble concentration according to a contaminated degree of the laundry.

In addition, the controller 130 controls the RPM of the motor or driving of the water supply device 20 or drying device 40 to effectively remove the bubbles after the bubble washing operation.

The driving unit 140 drives the motor 13, washing heater 16, water supply valves 23 and 24, assistant water supply valve 32, detergent liquid input valve 33, drying fan 41, drying heater 44, drainage pump 52, air motor 61, etc. in response to driving control signals from the controller 130.

There will be described hereinafter operation and advantageous effect of the washing machine constructed as above and the control method thereof.

The control method of the washing machine according to the present invention is to allow the washing machine to proceed a general washing course to wash general laundry and a bubble washing course to wash delicate laundry (for example, wool or silk which requires a delicate washing operation) through a bubble washing operation. The signal input unit 100 of the washing machine includes buttons with which a user can select the washing courses.

Figure 3:
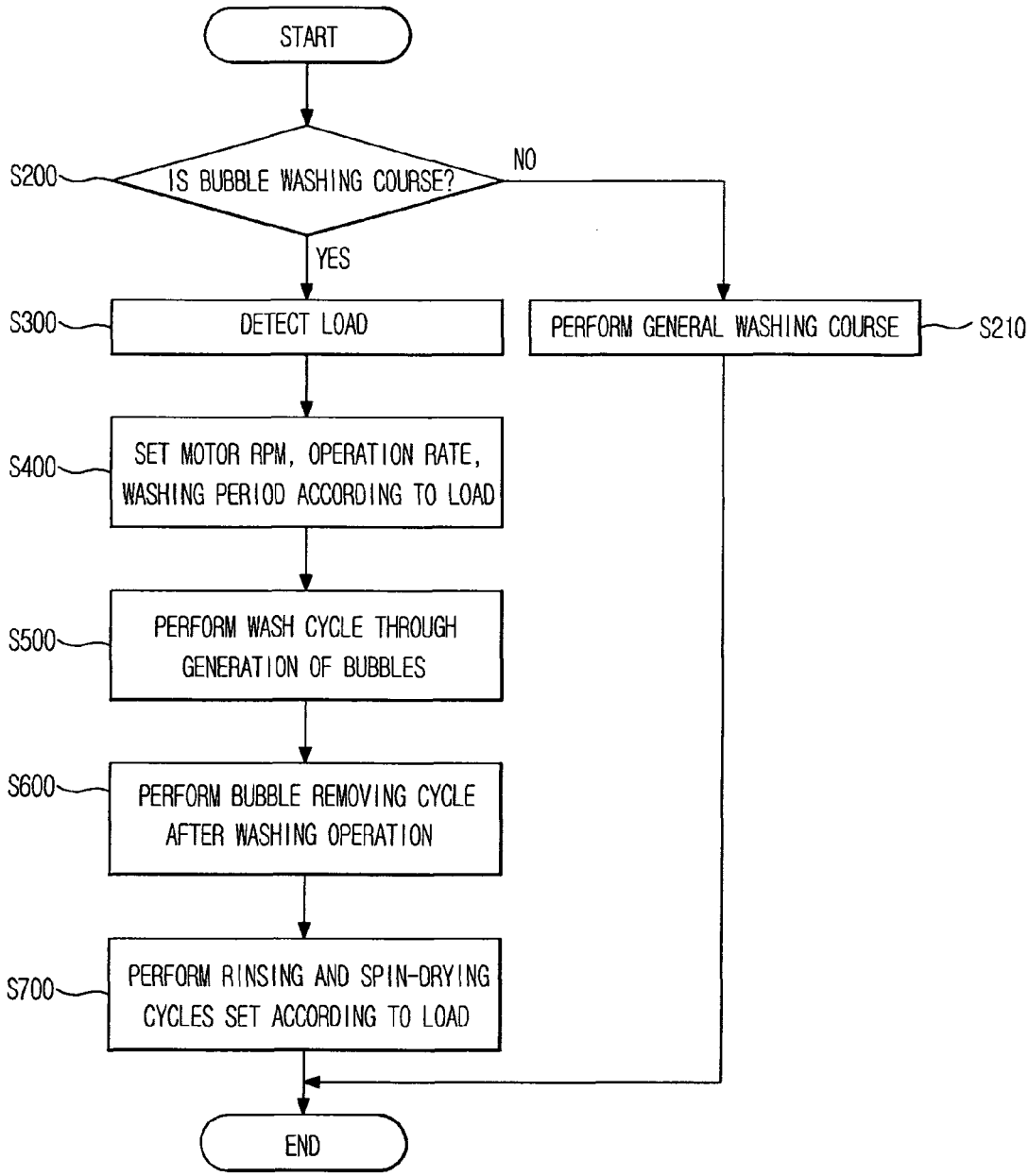
FIG. 3 is a flow chart illustrating the overall procedure of a control method of the washing machine to perform a bubble washing operation.

FIG. 3 is a flow chart illustrating the overall procedure of the control method of the washing machine to perform the bubble washing operation.

With laundry inputted into the rotational drum 12, operation information such as a washing course (bubble washing or general washing), a washing temperature, a spin-drying RPM, additional rinsing, etc. is selected according to a kind of laundry, and inputted to the controller 130 through the signal input unit 100.

The controller 130 determines whether or not the selected washing course is a bubble washing course in response to an input of the operation information from the signal input unit 100 (S200), and controls the washing machine to perform the same general washing course as that of a conventional technique if it is determined that the selected washing course is not the bubble washing course (S210).

If the selected washing course is the bubble washing course, the controller 130 receives information about a washing load (weight of the laundry) of the rotational drum 12 (S300), and sets an amount of water, an RPM and operation rate of the motor (on-off time of the motor), and a washing period based on the received information about the load (S400).

Then, the controller 130 allows the washing machine to perform a wash cycle via generation of bubbles with the set RPM, operation rate and washing period (S500), and to perform a bubble removing cycle to effectively remove the bubbles remaining in the rotational drum 12 after the bubble washing operation (S600).

As for the wash cycle via the generation of the bubbles, the bubbles act as a cushion for friction between the laundry, and reduce damage of texture of laundry due to the friction between the laundry and a strong water stream. In addition, a high detergent concentration of the bubbles enables dirt on the laundry to be effectively removed with only a small amount of water, thereby reducing energy consumption.

After performing the wash cycle via generation of the bubbles and the bubble removing cycle, rinsing and spin-drying cycles set corresponding to the load are performed (S700).

Next, there will be described the process (S500) of performing a wash cycle via generation of bubbles with reference to FIG. 4.

Figure 4:
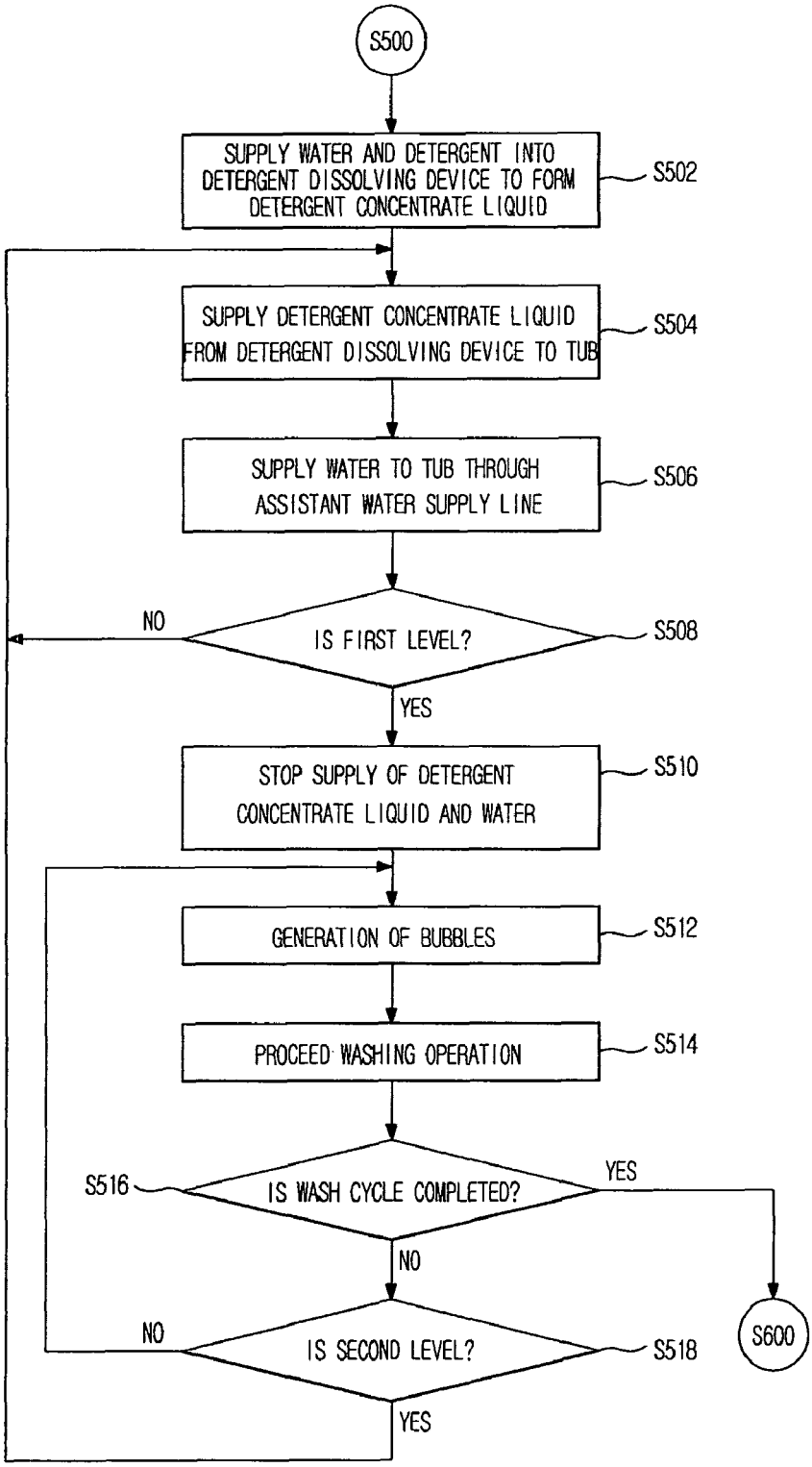
FIG. 4 is a detailed flow chart illustrating a wash cycle of the washing machine, in which the wash cycle is performed using the bubbles.

FIG. 4 is a detailed flow chart illustrating the wash cycle of the washing machine, in which the wash cycle is performed using bubbles.

When a bubble washing course is selected, the controller 130 controls the water supply device 20 to allow a small amount of water required for dissolving detergent to be supplied into the detergent dissolving apparatus 30 through the detergent supply device 19 via the water supply valve 24 and the water supply line 22. At this time, the detergent in the detergent supply device 19 is input along with the water into the detergent dissolving device 30 while being dissolved by the water so that detergent concentrate liquid (that is, water with the detergent concentrated therein) is contained in the detergent dissolving device 30 (S502).

Then, the controller 130 controls the detergent liquid input valve 33 to allow the detergent concentrate liquid in the detergent dissolving device 30 to be supplied into the tub 11 through the water supply nozzle 26 via the connection line 25 (S504), while controlling the assistant water supply valve 32 to allow the water to be supplied into the tub 11 through the connection line 25 and the water supply nozzle 26 via the assistant water supply line 31 without being supplied to the detergent supply device 19.

As such, the control is performed in such a way that, after the small amount of water (that is, an amount of water capable of forming detergent concentrate liquid of a high concentration by dissolving the detergent of the detergent supply device) is supplied once into the detergent supply device 19 at an initial water supplying stage, the water is directly supplied into the tub 11 through the assistant water supply line 31 along with the detergent concentrate liquid in the detergent dissolving device 30.

For better understanding of the present invention, although the detergent concentrate liquid and the water are illustrated as being sequentially supplied in FIG. 4, it is desirable that operations of supplying the detergent concentrate liquid and the water be performed simultaneously.

As the detergent concentrate liquid and the water are supplied into the tub 11, detergent water as a mixture of detergent concentrate liquid and water is formed between the tub 11 and the rotational drum 12. At this time, a level of detergent water is detected by the level detection unit 17, and the controller determines whether or not the level of the detergent water is a first preset level (the maximum level of the detergent water capable of preventing water supplied into the tub from flowing into the rotational drum, and corresponding to about ¼ of a level of detergent water in a general washing operation; a level detected by the first level sensor) (S508).

If the level of the detergent water is not the first level, the detergent concentrate liquid and the water are continuously supplied into the tub 11 until the level of the detergent water reaches the first level, and if the level of the detergent water is the first level, the controller 130 turns off the water supply valve 24, the assistant water supply valve 32 and the detergent liquid input valve 33 to stop supply of detergent concentrate liquid and water (S510).

Then, to wash the laundry using the bubbles within the rotational drum 12, air is supplied from the air supply device 60 to the detergent water formed of the mixture of detergent concentrate liquid and water to generate the bubbles (S512), followed by washing operation. At this time, the air supply device 60 generates the bubbles in such a way that, after being supplied from the air motor 61, air is dispersed through the porous member 62 via the air supply line 62, and is then forced into the detergent water as the mixture of detergent concentrate liquid and water through the air holes 64, generating the bubbles.

After being generated between the tub 11 and the rotational drum 12 via the air supply device 60, the bubbles are supplied into the rotational drum 12 through the holes or a front section of the rotational drum 12, and finally dispersed into the overall space of the rotational drum 12 after a predetermined period of time (about three minutes), enabling the laundry to be washed only with the bubbles within the rotational drum 12.

When generating the bubbles, it is desirable that an RPM and operation rate of the rotational drum 12, and a washing period therein be less than or equal to values set in each washing course corresponding to the load.

As such, dirt on the laundry can be effectively removed due to the high detergent concentration on the bubbles dispersed in the overall space of the rotational drum 12. At this time, the bubbles can act as a cushion with respect to fall of the laundry and friction between the laundry caused by rotation of the rotational drum 12, thereby preventing the texture of the laundry from being damaged due to the friction between the laundry.

Then, it is determined whether or not the wash cycle via the generation of the bubbles is completed (S516). If the wash cycle is completed, the process proceeds to the operation of S600 to perform rinsing and spin-drying operations.

If the wash cycle is not completed, the amount of detergent water is gradually reduced while the wash cycle via the generation of the bubbles proceeds. At this time, the level detection unit 17 detects a level of the lowering detergent water, and determines whether or not the level of the detergent water reaches a second preset level (the minimum level of detergent water required for generation of the bubbles; a level detected by the second level sensor) (S518).

If the level of the detergent water does not reach the second level, the process returns to the operation of S512 to continue the washing operation via rotation of the rotational drum 12 along with generation of the bubbles until the level of the detergent water reaches the second level. When the level of the detergent water reaches the second level, the process returns to the operation of S504 to start supply of detergent concentrate liquid and water corresponding to a reduced amount of the detergent water.

Specifically, the water supply valve 24 and the assistant water valve 32 are opened with operation of the water supply device 20, allowing water to flow through the assistant water supply line 31 instead of the detergent supply device 19, and then to be additionally supplied into the tub 11 through the water supply nozzle 26 via the connection line 25. At the same time, the detergent input valve 33 is opened, allowing the detergent concentrate liquid of a high detergent concentration in the detergent dissolving device 30 to be also supplied into the tub 11.

That is, in the case where the amounted of detergent water is reduced due to generation of the bubbles, if only the water is supplied into the tub without supplying the detergent, it is difficult to generate the bubbles having a predetermined detergent concentration due to a reduced detergent concentration on the bubbles. Thus, the predetermined amount of detergent concentrate liquid in the detergent dissolving device 30 is also supplied upon additional supply of the water.

The amount of the detergent concentrate liquid supplied from the detergent dissolving device 30 is so determined that, when 1 drop of detergent concentrate liquid having a predetermined concentration is supplied into the tub 11, the water is also supplied at an amount proportional to this detergent concentrate liquid. For example, assuming an amount of detergent water required by the tub 11 is 10, the controller controls the washing machine to supply 1 drop of detergent concentrate liquid and an amount of water proportional to this detergent concentrate liquid into the tub 11, and assuming an amount of detergent water required by the tub 11 is 20, the controller controls the washing machine to supply 2 drops of detergent concentrate liquid and an amount of water proportional to this detergent concentrate liquid, that is, two times of the above case, into the tub 11.

As such, the control method of the present invention enables the bubble washing operation to be effectively performed always using the bubbles having the predetermined detergent concentration by allowing the predetermined amount of detergent concentrate liquid to be supplied together with additional supply of water into the tub.

Figure 5:
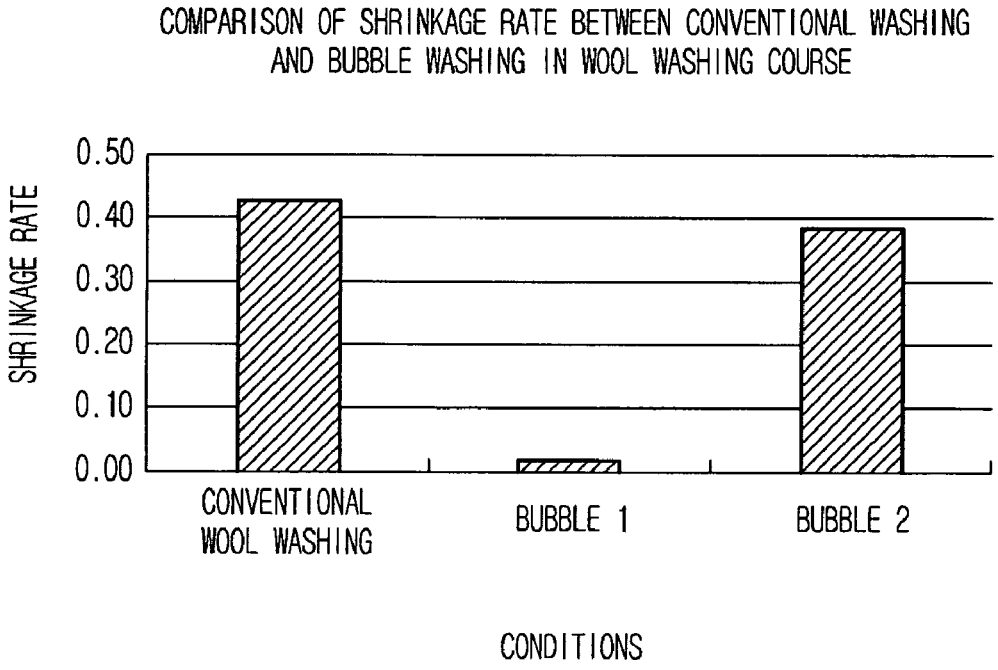
FIG. 5 is a graph depicting a shrinkage rate of laundry when washing the laundry in such a way of reducing an amount of water and supplying only the bubbles at the same concentration in the same wash cycle.
Figure 6:
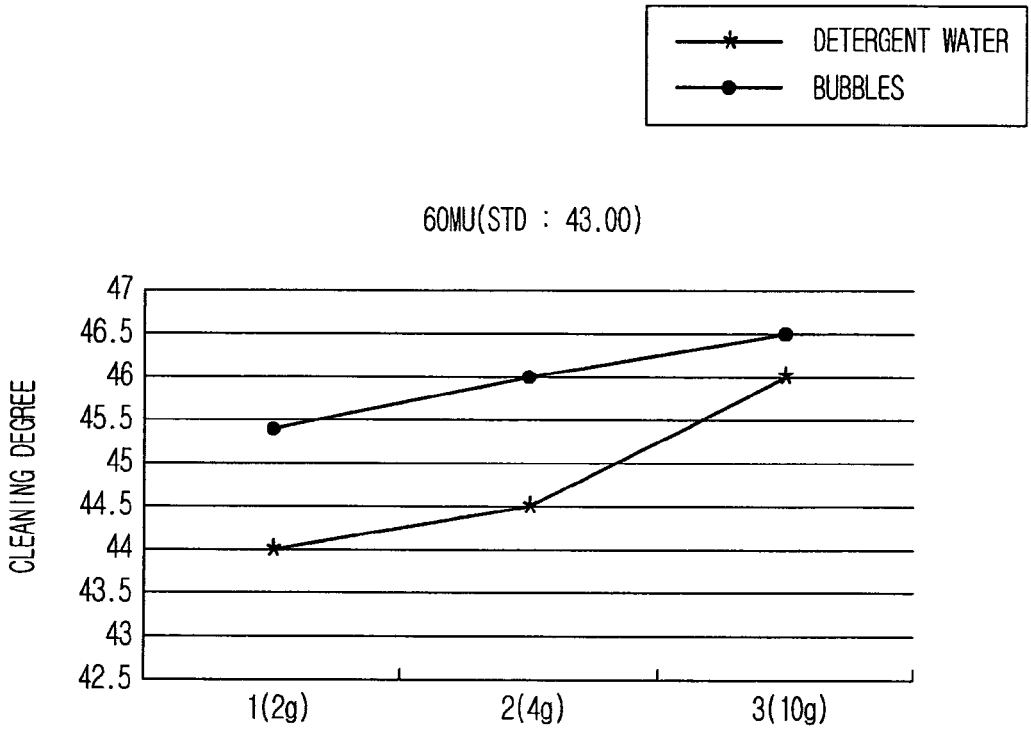
FIG. 6 is a graph depicting a cleaning degree of contaminated laundry of 60 MU (Make Up) depending on an amount of detergent, comparing the case of using detergent water with the case of using bubbles at the same detergent concentration.

Results of the wash cycle using the bubbles according to the present invention are shown in FIGS. 5 and 6.

FIG. 5 is a graph depicting a shrinkage rate of laundry when washing the laundry in such a way of reducing an amount of water and supplying only bubbles at the same concentration in the same wash cycle.

In FIG. 5, "conventional wool washing" indicates a shrinkage rate of wool when a wash cycle is performed at an RPM of 25 and at an operation rate of 1 second-On and 78 seconds-OFF for a washing period of 10 minutes, "Bubble 1" indicates a shrinkage rate of wool when the wash cycle is performed at an RPM of 25 and at an operation rate of 1 second-On and 78 seconds-OFF for a washing period of 10 minutes as in the conventional wool washing, and "Bubble 2" indicates a shrinkage rate of wool when the wash cycle is performed at an RPM of 25 and at an operation rate of 2 second-On and 78 seconds-OFF for a washing period of 10 minutes, which is different from the conventional wool washing in terms of operation rate.

As can be seen from FIG. 5, it is found that Bubble 1 exhibits a noticeably reduced shrinkage rate of the laundry compared with the conventional wool washing, and Bubble 2 exhibits a reduced shrinkage rate of the laundry compared with the conventional wool washing in spite of its higher operation rate than that of the conventional wool washing.

FIG. 6 is a graph depicting a cleaning degree of contaminated laundry of 60 MU (Make Up) in terms of reflective index at the same amount (2 g, 4 g, 10 g) of detergent, comparing the case of using detergent water with the case of using bubbles, both of which have the same detergent concentration.

As can be seen from FIG. 6, the cleaning degree of the laundry through the wash cycle using the bubbles is noticeably higher than that using the general detergent water.

Next, there will be described a process (S600) of removing bubbles remaining in the rotational drum 12 after performing a bubble wash cycle with reference to FIGS. 7 to 9.

Figure 7:
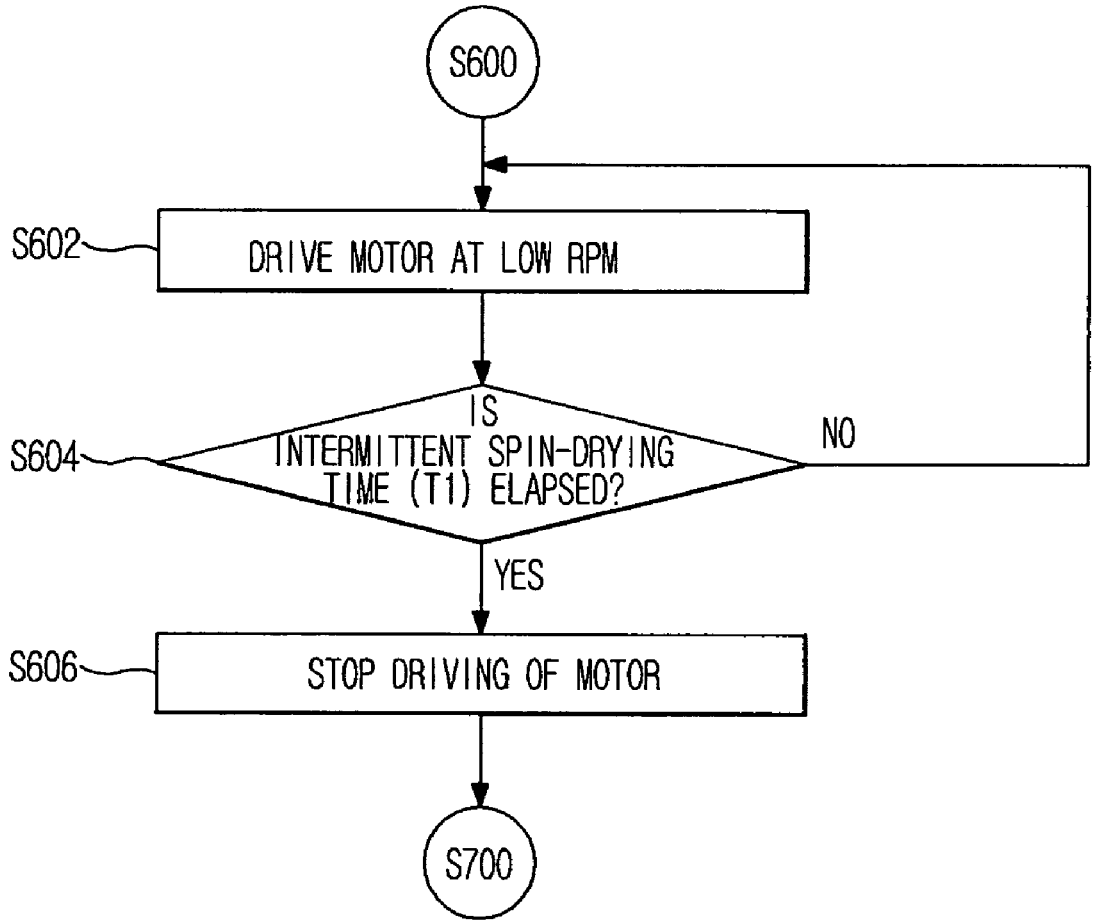
FIG. 7 is a detailed flow chart showing a first cycle to remove the bubbles after a bubble washing operation by the washing machine.

FIG. 7 is a detailed flow chart showing a first cycle of the washing machine to remove the bubbles after performing the bubble wash cycle. In the first cycle, after the detergent water is drained to the outside on completion of the bubble wash cycle, a bubble removing cycle is performed to remove the bubbles remaining in the rotational drum 12 instead of directly performing a rinsing cycle.

After draining the water on completion of the bubble wash cycle, the bubbles are removed by intermittent spin-drying during which the motor 13 is driven at a low RPM (for example, about 400 RPM) (S602).

It is determined whether or not a preset intermittent spin-drying time (T1: the minimum time required to remove the bubbles in the rotational drum through the spin-drying) elapses by counting the time of driving the motor 13 at the low RPM (S604), and if it is determined the preset intermittent spin-drying time elapses, driving of the motor 13 is stopped (S606).

Figure 8:
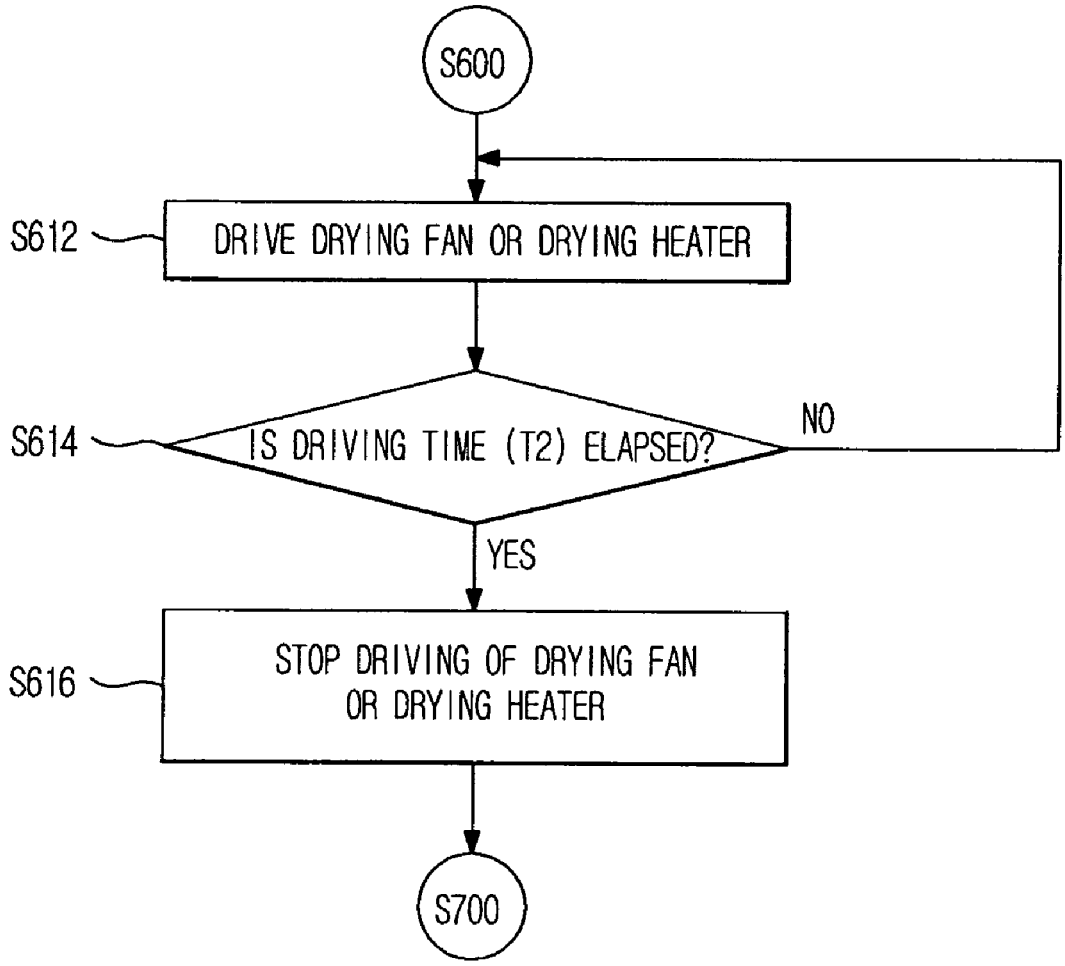
FIG. 8 is a detailed flow chart showing a second cycle to remove the bubbles after the bubble washing operation by the washing machine.

FIG. 8 is a detailed flow chart showing a second cycle to remove the bubbles after the bubble wash cycle by the washing machine of the present invention. In the second cycle, after draining the detergent water on completion of the bubble wash cycle, the bubble removing cycle is performed to remove the bubbles remaining in the rotational drum 12 instead of directly entering the rinsing cycle.

After draining the water or when blowing air through driving of the drying fan 41 simultaneously with water drainage, the drying heater 44 is driven to supply hot air, thereby removing the bubbles (S612).

It is determined whether or not a preset driving time (T2: the minimum time required to remove the bubbles in the rotational drum through air or hot air-blowing) elapses by counting the time of driving the drying fan 41 or the drying heater 44 (S614), and if it is determined the preset driving time elapses, the driving of the drying fan 41 or the drying heater 44 is stopped (S616).

Figure 9:
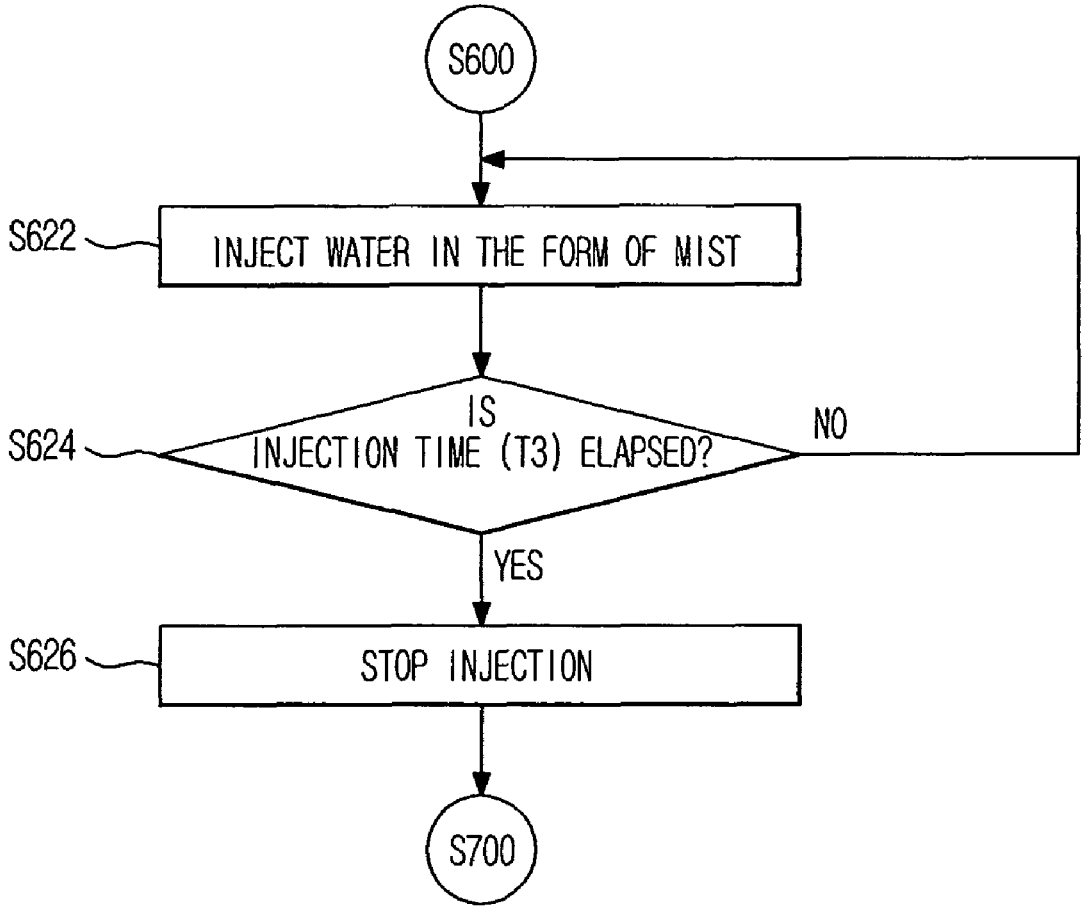
FIG. 9 is a detailed flow chart showing a third cycle to remove the bubbles after the bubble washing operation by the washing machine.

FIG. 9 is a detailed flow chart showing a third cycle to remove the bubbles after the bubble wash cycle by the washing machine. In the third cycle, after draining the detergent water on completion of the bubble wash cycle, the bubble removing cycle is performed to remove the bubbles remaining in the rotational drum 12 instead of directly entering the rinsing cycle.

While separately or simultaneously performing the driving of the motor 13 at the low RPM and the driving of the drying fan 41 or the drying heater 44, the water supply device 20 is controlled to inject a small amount of water in the form of spray between the rotational drum 12 and the tub 11 through the water supply line 26, thereby removing the bubbles (S622).

It is determined whether or not a preset injection time (T3: the minimum time required to remove the bubbles in the rotational drum through spray injection) elapses by counting the time of injecting the water (S624), and if it is determined the preset injection time elapses, the spray injection is stopped (S616), thereby completing the bubble removing cycle.

As apparent from the above description, the washing machine and the control method thereof according to the present invention enables laundry to be washed only with bubbles without direct contact with water so that the bubbles act as a cushion to reduce friction between the laundry, thereby preventing texture of expensive laundry (such as wool or silk) from being damaged due to the friction between the laundry and strong water stream, while allowing dirt on the laundry to be effectively removed due to a high detergent concentration on the bubbles.

In addition, the washing machine and the control method thereof according to the present invention uses a small amount of water, thereby enabling reduction in water consumption and energy consumption to heat the water, and preventing damage and deformation of the laundry when washing general laundry.

Furthermore, the washing machine and the control method thereof according to the invention can generate the bubbles having a predetermined detergent concentration through control of a water supply amount and a detergent input amount upon a bubble washing operation, and can adjust the detergent concentration on the bubbles so as to be suitable to a contaminated degree of the laundry, providing a high cleaning degree not only for a delicate washing operation but also for a general washing operation.

Although few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A control method of a washing machine performing a washing operation using bubbles, and including a rotational drum containing laundry, a water tub and a bubble generating device positioned outside the water tub to generate bubbles into the water tub, the method comprising:

supplying washing water containing detergent into a space between a lower portion of the rotational drum and a lower inner surface of the water tub such that a top surface of the washing water containing detergent reaches a predetermined first level lower than the laundry;

stopping the supply of the washing water containing detergent when the top surface of the washing water containing detergent reaches the predetermined first level, and controlling the bubble generating device to generate bubbles between the water tub and the rotational drum;

performing a washing operation to wash the laundry input into the rotational drum, using the bubbles; and determining whether the top surface of the washing water containing detergent reaches a predetermined second level lower than the predetermined first level as the washing operation is performed, and supplying a washing water such that the top surface of the washing water containing detergent reaches the predetermined first level when it is determined that the top surface of the washing water containing detergent reaches the predetermined second level, wherein the generating of the bubbles is performed when rotating the rotational drum at a washing RPM or less, the washing RPM generating a centrifugal force smaller than an acceleration of gravity.

2. The method according to claim 1, wherein the washing water containing detergent is generated by passing a small amount of water through a detergent supply device having detergent therein, supplying the small amount of water and the detergent to a detergent dissolving device.

3. The method according to claim 1, wherein the washing water containing detergent is supplied at a constant amount into the space between the rotational drum and the tub to maintain a concentration of the washing water containing detergent.

4. The method according to claim 1, wherein a supply amount of the water is controlled at a predetermined ratio to an input amount of the washing water containing detergent in the space between the rotational drum and the tub so as to maintain concentration of the washing water containing detergent.

5. The method according to claim 1, wherein, when the level of the washing water containing detergent is at a bubble generating level, the bubbles are generated by injecting air to the washing water containing detergent.

6. The method according to claim 1, wherein the removing of the bubbles further comprises at least one more of removing the bubbles through intermittent spin-drying after water drainage, and removing the bubbles through air-blowing with the drying fan after the water drainage.

7. The method according to claim 6, wherein, when blowing air with the drying fan, a drying heater is operated to supply hot air.

8. The method according to claim 1, further comprising:

removing the bubbles remaining on the laundry after performing the washing operation using the bubbles by removing the bubbles through air-blowing with a drying fan simultaneously with a water discharge without performing an intervening rinsing operation.

9. The method according to claim 1, wherein the bubble generating device comprises:

an air motor positioned outside the water tub to supply air;

an air supply line to transfer the air supplied from the air motor; and a bubble generating member positioned at an end of the air supply pipe to inject the transferred air and to generate the bubbles.

* * * * *